United States Patent [19]

Vornfett

[11] 4,114,488

[45] Sep. 19, 1978

[54] APPARATUS FOR FEEDING AND CHECKING SEPARATED LONGITUDINAL SUBJECTS

[75] Inventor: Karl-Ulrich Vornfett, Barsbuttel, Fed. Rep. of Germany

[73] Assignee: Friederich Justus & Co., Hamburg, Fed. Rep. of Germany

[21] Appl. No.: 761,330

[22] Filed: Jan. 21, 1977

[30] Foreign Application Priority Data

Jan. 23, 1976 [DE] Fed. Rep. of Germany ... 7602165[U]

[51] Int. Cl.[2] ..... B26D 3/20

[52] U.S. Cl. ..... 83/198; 83/371; 83/580; 83/98

[58] Field of Search ..... 83/371, 98, 198, 580

[56] References Cited

U.S. PATENT DOCUMENTS

| | | | |
|---|---|---|---|
| 2,565,727 | 8/1951 | Henderson | 83/371 |
| 2,652,864 | 9/1953 | Anguera | 83/371 |
| 3,362,272 | 1/1968 | Grosse | 83/198 |
| 3,648,553 | 3/1972 | Tuschy et al. | 83/98 |

*Primary Examiner*—Donald R. Schran

*Attorney, Agent, or Firm*—Cushman, Darby & Cushman

[57] ABSTRACT

Apparatus for moving uniformly colored elongated objects, such as raw potato sticks, peeled raw carrots, etc., past sensing equipment. The sensing equipment scans the elongated objects for areas which deviate in color from the essentially uniform color thereof and actuates cutting means which thereafter removes the area of discoloration.

8 Claims, 6 Drawing Figures

APPARATUS FOR FEEDING AND CHECKING SEPARATED LONGITUDINAL SUBJECTS

The invention relates to an apparatus for the transportation and testing of individual, elongated objects, such as raw potato sticks, peeled raw salsify, peeled raw carrots, etc., which have essentially uniform coloring over their entire length. The apparatus includes a feeding assembly having at least one feeder trough within which the individual objects are moved along a predetermined path of movement as well as a scanning assembly cooperating with one operational area of the feeder trough for sensing the presence of spots on or in the elongated objects which deviate in color from the essentially uniform color of the object.

One type of apparatus of this kind is known in the prior art which employs feeder troughs which are slanted in relation to horizontal to such an extent that the elongated objects, especially potato sticks, move along such troughs as a result of gravity. Such objects, i.e. potato sticks, are checked at a point along the feed path by means of a scanning arrangement, customarily a photocell arrangement, for the existence of dark spots and upon the sensing of such dark spots, the potato stick is removed by means of compressed air.

However, feeding difficulties arise in such prior art devices insofar as the transportation of the elongated objects along the slanted feeder troughs is concerned since when such feeding is disturbed which can frequently occur, individual objects tend to slide on top of one another causing undesirable pileups which must be cleared before proper feeding and testing can resume.

Another type of known apparatus for the transportation and testing of individual, elongated objects, such as small potato sticks, passes raw potato sticks through a pipe together with a stream of water flowing at a known speed so that the potato sticks are moved past a scanning area in the pipe. The pipe is transparent or translucent, at least in the sensing area so that corresponding scanning arrangements in the scanning area can determine the presence of spots on the potato sticks of a deviating coloration. Then at the end of the pipe a sorting force is produced by means of a jet of compressed air flowing in a transverse direction to the direction of feed of the sticks so that in theory those elongated objects in which spots deviating in coloration had been found are removed from the stream of objects.

This known arrangement has the disadvantage, however, that beside the objects properly sorted out, because of the presence of spots deviating coloration, it also sorts out objects which have no deviating coloration. In the case of use of such an apparatus for the transportation and testing of small potato sticks, it has been found that about 30% of the sorted out small potato sticks have no dark spots and, therefore, had been sorted out unnecessarily.

It is of course desirable to be able to recover the incorrectly sorted potato sticks or articles, i.e. those objects having no dark spots or coloration problems that recovery process could possibly be accomplished by reprocessing all potato sticks or objects which were initially rejected during the initial sorting process. That resorting process would, however, still reject any of the elongated objects in which dark spots or areas existed. Applicant has also found, however, that it is possible to likewise recover for use those parts of the elongated objects, such as potato sticks which lie adjacent dark spots but in which no dark spots exist. It has been found, for example, that dark spots occur frequently at the end of small potato sticks while the remaining portion of such sticks contain no dark spots and would be, therefore, usable without further processing.

For the solution of this task of separating out those places within individual elongated objects deviating in coloration from the remaining parts of the elongated objects, an apparatus of the initially mentioned type has now been developed. A cutting assembly is provided which can be activated by the scanning assembly and which has two knives coupled with one another and spaced apart from one another in the direction of the path of movement of the elongated objects. The knives can be moved downward from a raised rest position into or through the path of movement of the elongated objects. Preferably, the cutting assembly is provided in the operating area of the feeder trough which, in a preferred embodiment, consists of a vibrating trough. Likewise the scanning assembly can be located above the operating area of the feeder trough.

Thus, it is possible with the arrangement according to the invention to either cut off or cut out the discolored section from the elongated objects through the movement of the cutting assembly in response to the sensing of spots deviating in coloration on or in said elongated objects. Thus, discolored, terminal areas can be cut off the elongated objects with the apparatus according to the present invention and it will also be possible to remove any discolored areas which are located in a central part of the elongated objects.

In a preferred embodiment of the invention, the cutting arrangement contains a part of the feeder trough which as compared to the remaining feeder trough, can be moved out of a normal operating or rest position downward in a vertical direction, and the knives are attached at a distance above the trough surface.

The removal of the sensed discolored areas take place with this cutting arrangement by a simple lowering of the part of the feeder trough so that the knives will either cut off or cut out the discolored area and simultaneously move it downwards into an area below the actual feeder trough from which then the cut out or cut off section can be removed.

After return of the part of the feeder trough upwards back into the rest position, movement of the elongated objects through the feeder trough and the testing thereof can be continued.

In another embodiment of the present invention, the two knives have cutting edges shaped so as to correspond to the internal shape of the support surface for the elongated objects formed by the inside of the feeder trough. The knives can be lowered from a lifted rest position down onto the support surface. The section of the elongated object cut by the knives during the lowering action and occupying the space therebetween is held during the return of the knives into the rest position between the knives and may thereafter be removed while the transportation and testing of the elongated objects is continued.

The removal of the separated sections is accomplished preferably in an area outside of the path of movement of the elongated objects for example by means of a jet of air.

The present invention will be explained in more detail in the following paragraphs on the basis of the figures showing the above-described embodiments.

Figure 1:
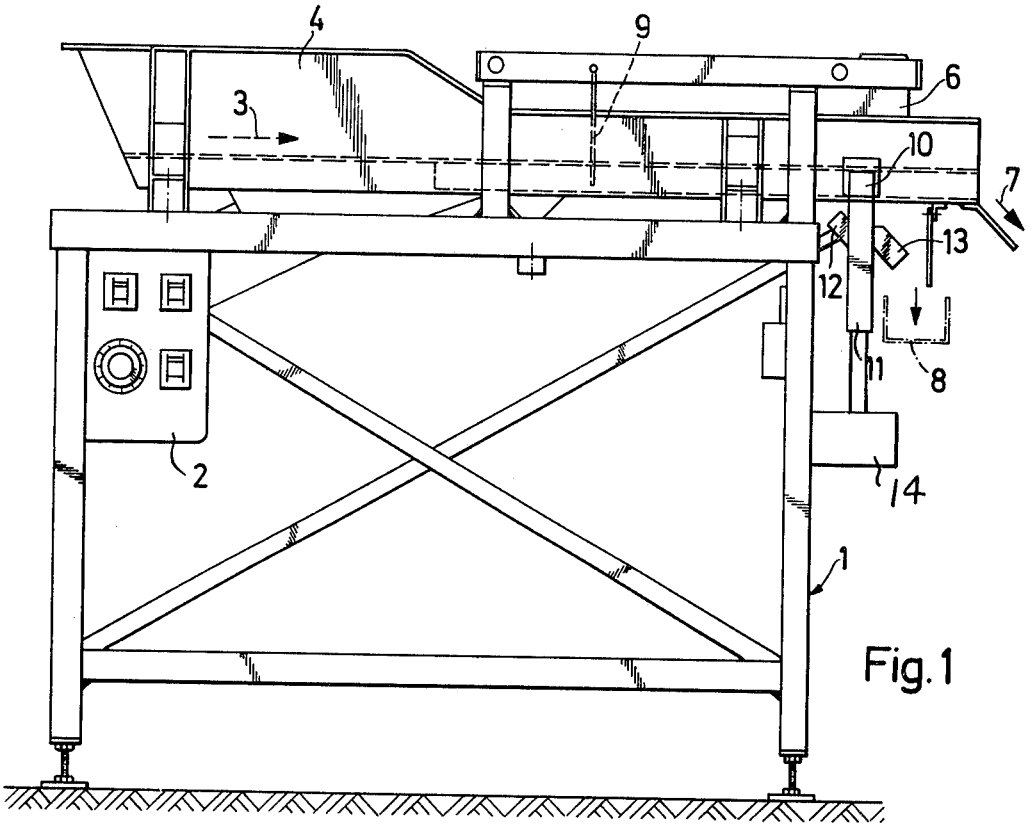
FIG. 1 shows schematically a side elevation of the apparatus for transportation and testing according to the present invention.
Figure 2:
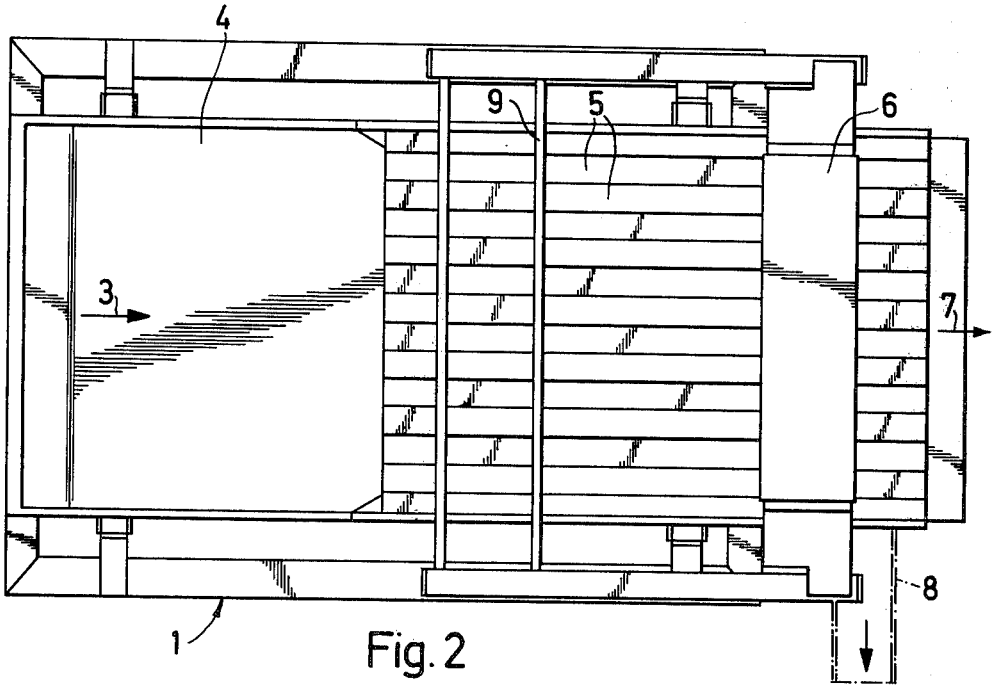
FIG. 2 shows a top plan view of the apparatus shown in FIG. 1.

The apparatus shown in FIGS. 1 and 2 has a stand or frame 1 on which a receiving tank 4 has been disposed with a number of adjoining feeder troughs 5. The receiving tank 4 and feeder troughs 5 can be put into a shaking and vibrating motion in the direction of the longitudinal extension of the feeder troughs 5 by means of an oscillating drive (not shown) which is controlable by way of the control panel 2. Through the shaking of the tank 4 and feeder troughs 5 the elongated objects reaching the receiving tank 4, say small potato sticks, are moved in the direction of arrow 3 and will reach essentially individually the feeder troughs 5. The objects are moved through these feeder troughs as a result of the shaking movement along a predetermined path of movement and a stripper member 9 secured to and depending from frame 1 so as to extend into each feeder trough 5. Each stripper member 9 projects into the feeder troughs 5 but is spaced above the bottom thereof by a distance at least equal to the thickness of the elongated objects being moved so as to make sure no superposed objects are moved but that in fact a separation of the objects takes place.

In consequence of the shaking movement, the objects reach the operating area of the feeder troughs 5, above which area a scanning assembly 6 consisting of photoelectric cells is attached to frame 1.

Figure 3:
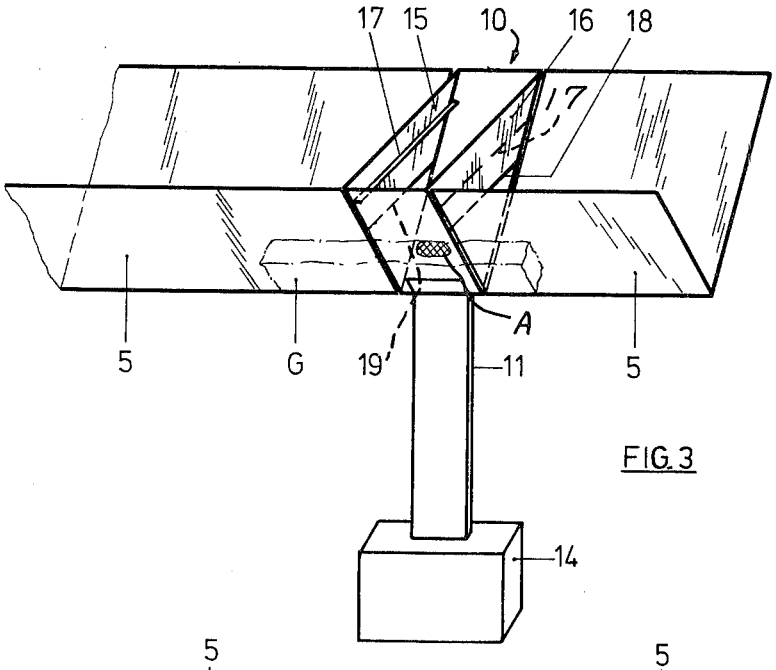
FIG. 3 shows in a partial presentation a first embodiment of a cutting arrangement with knives shown in their rest position.
Figure 4:
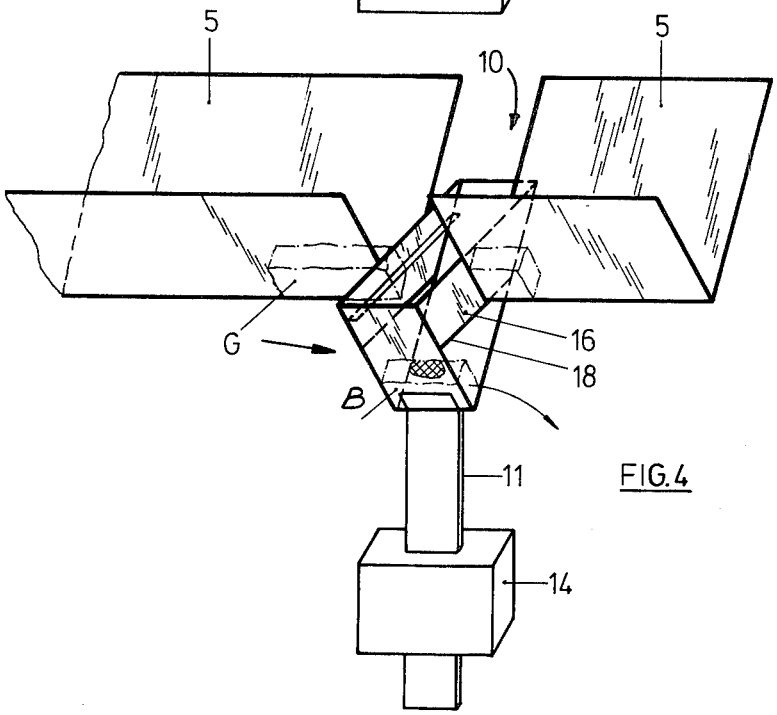
FIG. 4 shows the cutting arrangement of FIG. 3 in the position for removal of the separated section of the elongated object.

The construction of the feeder troughs which can be employed in the operating area can be seen from the partial presentations shown in FIGS. 3 and 4. As these figures show, a portion of the troughs 5 generally indicated at 10, is movable with respect to the remaining feeder trough. The trough portion 10 of feeder trough 5 is connected on its bottom side to rod 11 which extends into a schematically shown drive 14 which may be of a conventional construction and which may comprise of a pneumatically operable piston cylinder arrangement or a geared drive means, it only being essential to be able to move rod 11 and thereby trough portion 10 vertically between the rest and lowered positions shown in FIGS. 3 and 4.

At the lateral ends of trough portion 10, knives 15 and 16 are attached and extend transversely thereacross. Knives 15 and 16 and are respectively provided with cutting edges 19 and 18 which edges are positioned above the bottom of feeder trough 5 and elongated objects G passing therethrough when trough portion 10 is in its raised operating position (FIG. 3). Thus, objects with the largest expected diameter will still be freely movable below the knives 15 and 16.

If the scanning assembly 6 senses an object in one of the feeder troughs 5 the coloration of which object in a partial area deviates from the normal coloration, as indicated in FIG. 3, by the area shown at A the scanning assembly 6 will actuate the corresponding drive 14 by any convenient means such as by closing a switch controlling actuation of drive 14, which moves trough portion 10 downward by means of connecting rod 11 so that the cutting edges 19, 18 of the knives 15, 16 will cut through the object in the area of the determined deviation of coloration forming a cut section B. In order to make sure that this cut section B separated out of the object will also be moved downwards with the part 10 of the feeder trough, stops 17 may be provided on the inside surfaces of knives 15 and 16 which cause a forcible guidance of the cut section B downwards.

Whenever trough portion 10 is in the position shown in FIG. 4, section B rests only on the supporting surface of trough portion 10 and each end is now exposed. When in its lowered position trough portion 10 positions the cut section G in alignment with a compressed air arrangement 12, shown in FIG. 1, which when activated forces cut section B out of trough portion 10 and into a refuse spout 8 by means of a guide 13.

When in the lowered state, that portion of knife 15 which extends above stop 17 lies adjacent part of the object G and thereby prevents the left-hand part of the object G (FIG. 4) from being moved further to the right in consequence of the continuing shaking movement of feeder trough 5. Only when trough portion 10, after ejection of cut section B, again returns into its rest position according to FIG. 3, can the left-hand part of the object G continue its movement along feeder trough 5.

It may happen that a cut section B which has been separated or separated out is held between the knives 15 and 16 and does not drop down onto the supporting surface of trough portion 10. In order to then achieve a removal of that cut section, the knife 15 may be provided with perforations so that a part of the jet of air from the compressed air arrangement 12 reaches the area between the knives and frees the cut section held therebetween so that it will reach the supporting surface and be removed.

If, after return of the trough portion 10 into its rest position it is found that the discolored segment has not been removed completely, then the previously described process is repeated.

In the embodiment shown, an optical scanning of the objects takes place only from above so that possibly discolored spots on the underside of the objects are not found. However, it is also possible to provide the scanning on the sides whenever the part 10 consists of translucent or transparent material so that then an almost complete checking of the object is accomplished.

Figure 5:
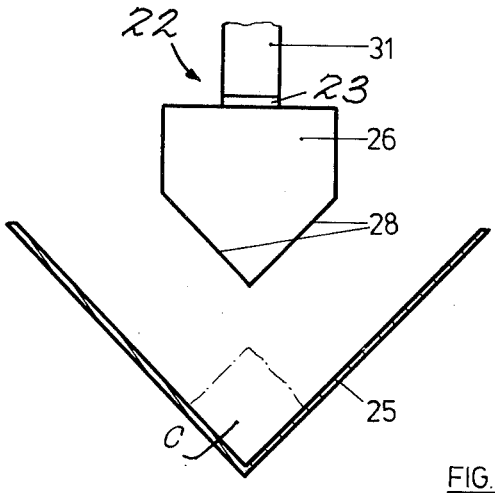
FIG. 5 shows schematically a side elevation of another embodiment of a cutting assembly in rest position.
Figure 6:
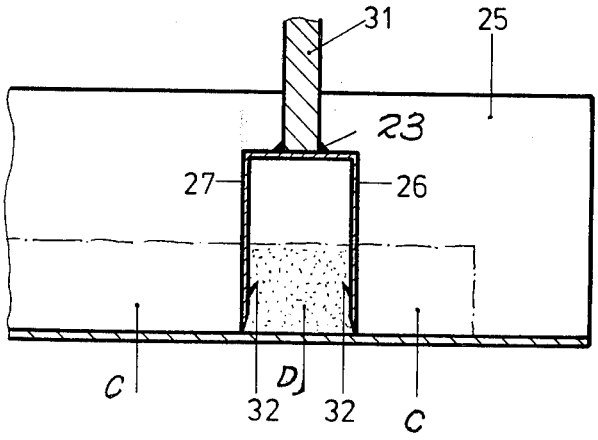
FIG. 6 shows the cutting arrangement of FIG. 5 in its lowered cutting position just prior to lifting a separated section out of an elongated object.

In the case of the second embodiment of the cutting assembly shown schematically in FIGS. 5 and 6, the scanning assembly has not been shown, but could be positioned either laterally beside the cutting arrangement or else in the direction of movement of the objects in front of the cutting assembly. The second embodiment of a cutting assembly shown generally at 22 is comprised of two knives 26 and 27 attached as by welding 23 to a vertically movable operating lever 31. Upon sensing of a discolored spot, lever 31 and knives 26 and 27 are lowered into the feeder trough 25 so as to cut into object C. The cutting edges 28 of knives 26 and 27 are formed so as to conform to the shape of the supporting surface of the feeder trough 25. Whenever knives 26 and 27 have been lowered completely as shown in FIG. 6, then the object C has been cut through forming a cut section D and barblike elements 32 on the inside surfaces of knives 26 and 27 engage with the cut section D. As a result, upon lifting of the cutting assembly 22, the cut section D is lifted together with knives 26 and 27 vertically in relation to the path of movement of the objects C in the feeder trough 25 and the cut section D may be removed when the cutting assembly 22 is in its raised position by means of a jet of air.

Removal of cut sections with the cutting assembly shown in FIGS. 5 and 6 is possible only whenever the section fills the entire space between knives 26 and 27. Therefore, objects must be in butting contact if ends of objects are to be cut or the operating arrangement should be aligned correspondingly in order to make sure that even if one end of an object is to be cut off, the section that is to be cut will completely fill the area between the two knives.

It will now be clear that there has been provided herein a method and apparatus which accomplishes the objectives heretofore set forth. While the invention has been disclosed and described in a preferred form, it is to be understood that the specific embodiment thereof as described and illustrated herein is not to be considered in a limited sense as there may well be other forms or modifications of the present invention which should also be construed as coming within the scope and spirit of the appended claims.

What is claimed is:

1. A device for removing discolored portions from elongated objects comprising:

feeding means for feeding elongated objects along a predetermined path, said feeding means including a portion adapted for movement between a first position where said movable portion forms a part of said feeding means aligned with said path, and a second position where said movable portion is moved out of said path, sensing means for sensing discolored portions within the elongated object and for producing a signal in response thereto, moving means operatively connected to said sensing means for moving the movable portion of said feeding means between said first and second positions in response to said signal, cutting means operatively connected to the movable portion of said feeding means and movable therewith so that when the movable portion of said feeding means is in its first position said cutting means is maintained out of the path of said elongated object and when said movable portion is moved to its second position said cutting means cuts through said elongated object so as to sever the discolored portion therefrom and removal means for removing segments cut out of said elongated objects from said cutting means.

2. Apparatus for transporting and testing individual, elongated objects which have an essentially uniform coloration over their entire length, said apparatus including support means for supporting said elongated objects, feeder means for moving the individual objects along said support means thereby defining a predetermined path of movement, scanning means positioned at a point along the predetermined path of movement for scanning the coloration of said elongated objects as said elongated objects are moved therethrough and for sensing spots deviating in coloration on or in said elongated objects, cutting means for cutting out segments of said elongated objects containing spots deviating in coloration, said support means including a movable portion adapted for vertical movement between first and second positions means for moving said movable portion between said first and second positions, said moving means being actuated by said scanning means upon the sensing of a spot deviating in coloration, said cutting means including two knives secured to said movable portion of said support means and spaced upwardly therefrom, said knives being spaced apart from one another a predetermined distance in the direction of the path of movement of said elongated objects, said cutting means being out of the path of movement of said elongated objects when said movable portion is in its first position so that when said movable portion is moved to its second position said cutting means passes through said elongated object a distance at least sufficient to sever a predetermined portion of said elongated object from the remaining portion of said elongated object and removal means for removing the cut segments from said cutting means.

3. The apparatus as in claim 1 wherein the sensing means is located above said feeding means.

4. The apparatus as in claim 1 wherein said feeder means includes a feeder trough having a surface for supporting said elongated objects as they are moved therethrough and means for vibrating said feeder trough.

5. The apparatus as in claim 4 wherein said cutting means includes first and second wall portions shaped to correspond to the shape of said feeder trough so that when said cutting means is in said first position said first and second wall portions form part of said feeder trough and two knives spaced apart from one another a predetermined distance in the direction of the path of movement of said elongated objects, said knives being attached to said first and second wall portions so as to extend across said feeder trough.

6. The apparatus as in claim 5 wherein when said cutting means is in said first position said knives are positioned a distance above the supporting surface of said feeder trough which is at least as large as the maximum diameter of said elongated objects and stop means projecting into the space between said knives for limiting movement of a cut portion of the elongated object lying between said knives.

7. The apparatus as in claim 1 wherein said removal means includes a compressed air means for producing a jet of air directed toward said cutting means and the cut segment of the elongated object when said movable portion is in its second position so as to move the cut segment off of said movable portion and into an area outside the path of movement of said elongated objects.

8. The apparatus as in claim 7 wherein at least one of said knives has perforations above its cutting edge to provide for the passage of at least a portion of the jet of air directed at said cutting means by said compressed air means.

* * * * *